US006733397B1

(12) United States Patent
Barrett

(10) Patent No.: US 6,733,397 B1
(45) Date of Patent: May 11, 2004

(54) MAGCANET THE MAGIC CANE AND CARD TO TABLE

(75) Inventor: Paul Richard Barrett, Delray Beach, FL (US)

(73) Assignee: Paul Barrett, Delray Beach, FL (US)

( * ) Notice: Subject to any disclaimer, the term of this patent is extended or adjusted under 35 U.S.C. 154(b) by 0 days.

(21) Appl. No.: 10/369,875

(22) Filed: Feb. 18, 2003

(51) Int. Cl.[7] ..... A63J 5/00
(52) U.S. Cl. ..... 472/82; 472/73; 446/129
(58) Field of Search ..... 472/73, 75, 81; 446/92, 129, 132, 137, 138; 248/206.5; 273/443, 456

(56) References Cited

U.S. PATENT DOCUMENTS

| | | | | | |
|---|---|---|---|---|---|
| 1,541,925 | A | * | 6/1925 | Davidson | 472/73 |
| 3,097,448 | A | * | 7/1963 | Prunkkard | 446/138 |
| 5,188,555 | A | * | 2/1993 | Zbegner | 446/133 |
| 5,472,211 | A | * | 12/1995 | McCaughan | 273/401 |

* cited by examiner

*Primary Examiner*—Kien Nguyen

(57) ABSTRACT

A magic trick that consist of a magician's cane and playing cards. The magician puts a playing card on top of the cane and puts the cane on top of another card on the floor. The cane is balanced and is now able to act as a table which will support the magicians tophat on top of the card on top of the cane.

8 Claims, 3 Drawing Sheets

INSTRUCTIONS METHOD 1
ILLUSTRATIONS

INSTRUCTIONS METHOD 2
ILLUSTRATIONS

INSTRUCTIONS METHOD 3
ILLUSTRATIONS

MAGCANET THE MAGIC CANE AND CARD TO TABLE

CROSS-REFERENCE TO RELATED APPLICATIONS

| | | |
|---|---|---|
| 512,381 | January 1894 | Keyes |
| 1,198,227 | September 1916 | Hinchey |
| 1,347,382 | July 1920 | Karro |
| 2,428,864 | July 1945 | Boyd |
| 2,471,764 | January 1946 | Miller |
| 2,947,563 | December 1957 | Stitt |
| 3,111,737 | April 1962 | Heil |
| 3,148,856 | October 1962 | Orlando |
| 3,169,791 | January 1962 | Twachtman |
| 3,171,176 | July 1962 | Shirley |
| 3,384,408 | May 1960 | Furzey |
| 3,582,123 | June 1971 | Kyser |
| 3,997,156 | December 1976 | Barlow |
| 4,802,702 | February 1989 | Bownds |
| 5,125,134 | June 1992 | Morita |
| 5,356,343 | October 1994 | Lovetere |

STATEMENT REGARDING FEDERALLY SPONSERED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The field of endeavor to which the invention pertains to is a magic trick. When performing card magic manipulation the magician uses a table to put his top hat on to put cards into. This invention gives the magician the ability to use his magic props and magic apparatuses, such as his cane, cards, and top hat. The Magician's cane and magic cards becomes a table for his top hat. This invention and methods allows the magician to incorporate and refine his card manipulation, making it a great utility device.

BRIEF SUMMARY OF THE INVENTION

This invention is a black aluminum cane, forty inches long with powerful neodymium magnets placed at both ends of the cane. This acts as a magnetic joint to hold a metal plate playing card flat on the top and on the bottom of the cane. The magician produces a metal plate card that appears to be a playing card and balances the card on the cane, which is held securely by the magnet, then the magician turns the cane upside down and the card act as the base for the table. Then, the magician produces another metal playing card as the tabletop and balances that on top of the cane, which is held securely by the second magnet. Then the magician can balance his top hat on top of the metal card on top of the cane. Also, by securely placing a flat metal washer to the inside bottom of the top hat prior to the performance, the magician can appear to balance the top hat directly on top of the cane. This invention will improve the ability of the magician to incorporate his hat, cane, and cards as more of a complete routine. Also, the magician could use four canes to produce even a larger table.

DETAILED DESCRIPTION OF THE INVENTION

Figure 1:
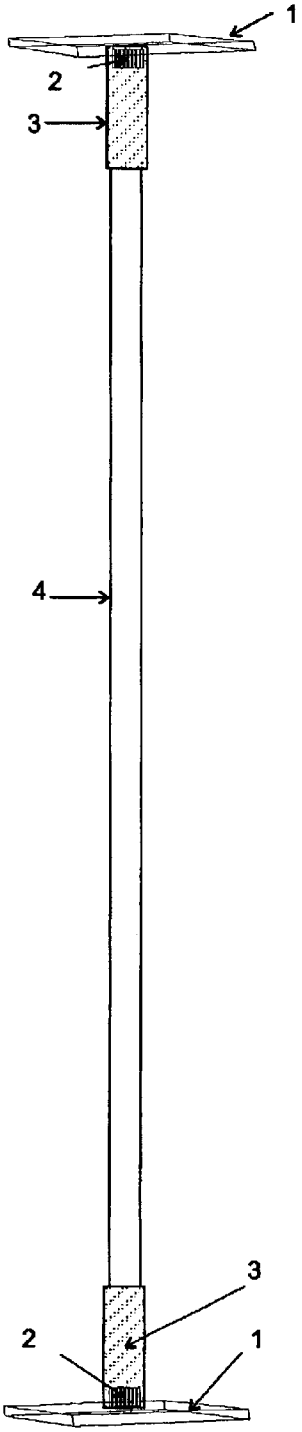
FIG. 1 is a perspective view of the invention with the metal plate card on the top and on the bottom of the cane.

FIG. 1 is a magic cane generally designated 4 with metal plate card 1 which are centered and magnetically attached by a neodymium magnet 2 to the top and bottom of the cane 4 to create the table-top and table-base of the table. The cane 4 table is created during the magic trick routine.

Figure 2:
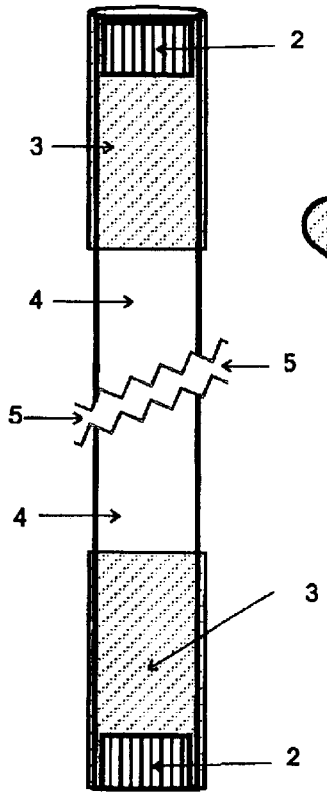
FIG. 2, is a exploded perspective view along lines 5—5 showing distal ends of the cane showing inner magnets and outer three inch long ornamental polished aluminum tube sleeve.

FIG. 2 shows the embodiment enlarged of the distal end of the top and bottom of the cane 4 with neodymium magnet 2 with polished aluminum sleeve 3. The neodymium magnet 2 is cemented with epoxy at the ends of the cane. Cane 4 is made of aluminum. The sleeve 3 is cemented with epoxy at the end of the cane.

Figure 3:
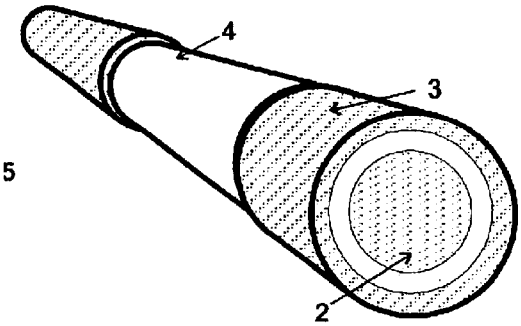
FIG. 3 is a perspective view of distal end of cane showing magnet and outer sleeve, this embodiment also represents top and bottom of the cane.

FIG. 3 shows the embodiment of the cane 4 showing the relationship of placement of the neodymium magnet 2, sleeve 3, and cane 4, this view represents the top and bottom of the cane 4.

Figure 4:
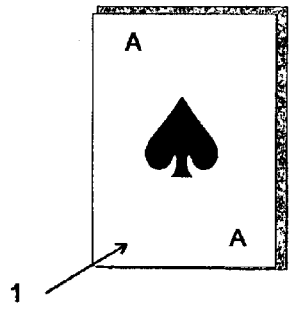
FIG. 4 is a perspective view of metal playing card.

FIG. 4 is the metal plate card 1, which is used:as the table base and tabletop This card looks like a real card but only it is made of metal. The larger the card used the more stability and greater strength the table has.

Figure 5A:
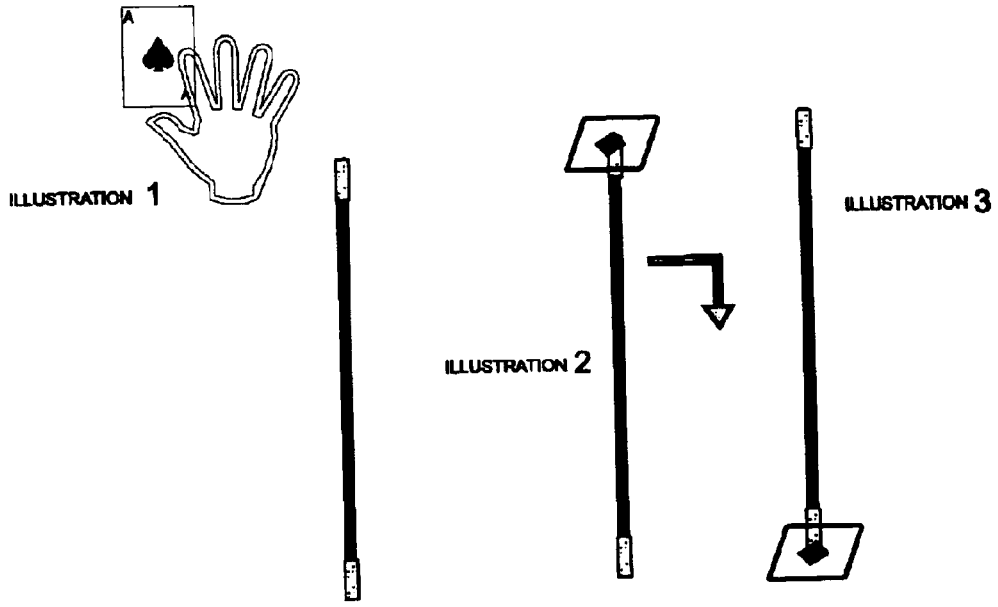
FIGS. 5A–5B are schematic view of the instructions for the magic trick.
Figure 5A:
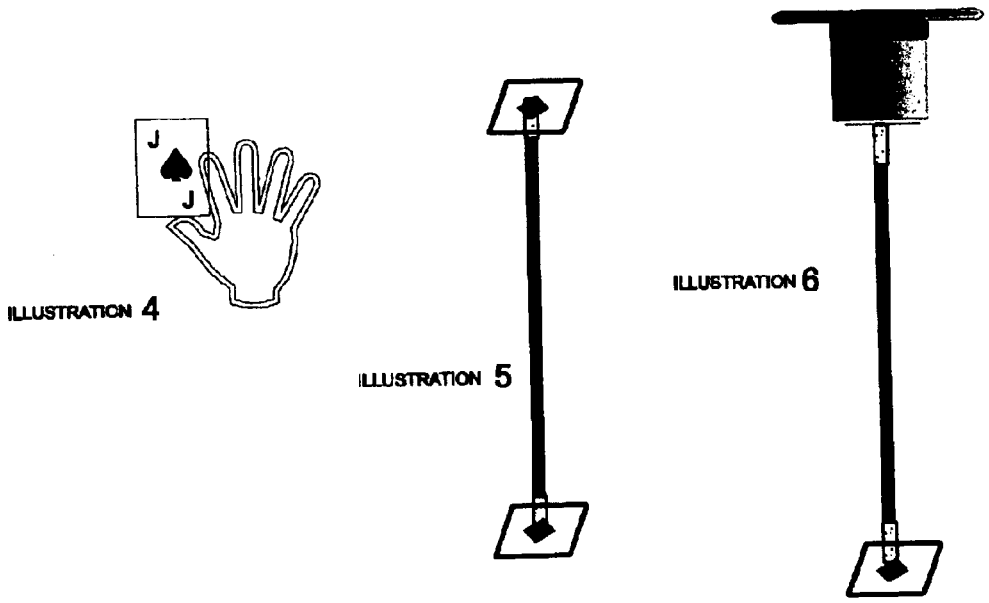
Figure 5B:
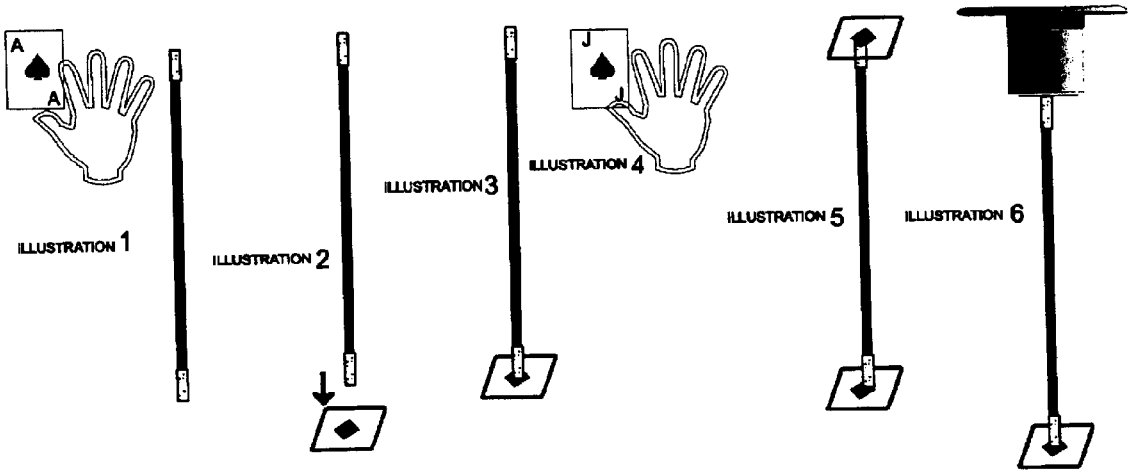
Figure 5B:
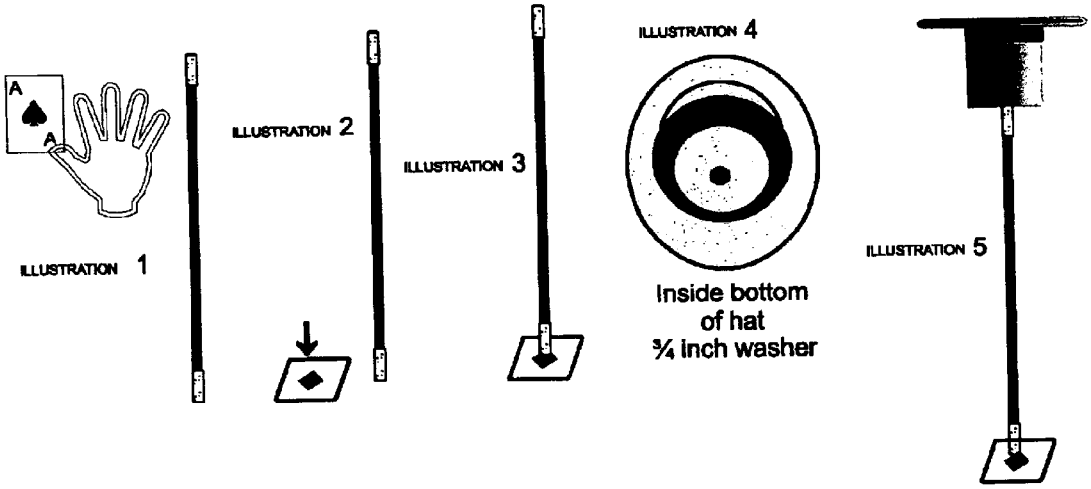

FIGS. 5A–5B is the indicia for instructions showing different methods of performing the magic trick using the cards, cane, and top hat. Each instruction has its own corresponding illustration for each step in the method.

METHOD 1

1. Magician produces a metal card by sleight of hand. Illustration 1.
2. Place metal card centered on top of the cane, the magnetic-pull is strong, and so practice is essential. Illustration 2.
3. Then turn the cane upside down and the cane will remain upright balanced on the metal card on the floor. Illustration 3.
4. Produce another metal card. Illustration 4.
5. Again, place the metal card centered on top of the cane. Illustration 5.
6. You can then balance your top hat on top of the card on top of the cane. Illustration 6.

METHOD 2

1. Magician produces the metal card by sleight of hand. Illustration 1.
2. Drop the card on the floor for misdirection with noise. Illustration 2.
3. Place the cane centered on top of the metal playing card. Illustration 3.
4. Produce another metal card. Illustration 4.
5. Place metal card centered on top of the cane, the magnetic-pull is strong, and so practice is essential. Illustration 5.
6. You can then balance your top hat on top of the card on top of the cane. Illustration 6.

METHOD 3

1. Magician produces the metal card by sleight of hand. Illustration 1.
2. Drop the card on the floor. Illustration 2.
3. Place the cane centered on top of the metal card. Illustration 3.
4. Secure a ¾ inch metal washer on the inside bottom of the top hat prior to the performance. Illustration 4.
5. You can then balance your top hat on top of the cane without using the metal card. Illustration 5.

There are other methods, such as producing a fan of six metal cards and drop them on the floor. This causes a very loud unexpected noise. Misdirection to steal real cards and start producing them. Also, a larger metal card can be used, the larger the card for the bottom, the stronger the base, hence, more stability for the cane is achieved.

What I claim as my invention is:

1. An amusement device for holding objects to accommodate use by a standing human comprising:

(a) an elongated tube of sufficient length to accommodate use by a standing human whereby, (b) said elongated tube having an opening at both distal ends whereby, (c) containing a magnet secured inside said elongated tube opening at each said distal end having an exposed magnet surface, whereby said magnets having sufficient magnetic attraction, (d) attaching to a plurality of magnetically permeable metal sheets, first said magnetically permeable metal sheet attaching on top of said elongated tube and second said magnetically permeable metal sheet attaching on the bottom of said elongated tube, said plurality of metal sheets having sufficient size for supporting said elongated tube and for holding objects to accommodate use by a standing human, (e) first means for attaching said magnetically permeable metal sheets horizontally at right angles to said elongated tube vertically at said distal ends of said elongated tube to said magnets, (f) second means for joining said elongated tube on top of first said magnetically permeable metal sheet as a support base and magnetically joining second said magnetically permeable metal sheet attaching magnetically to the underside of said magnetically permeable metal sheet on top of said elongated tube as a platform thereby holding objects on top of said magnetically permeable metal sheet to accommodate use by a standing human, (g) a set of instructions, paper sheets having indicia thereon representative of instructions and methods of using said amusement device for holding objects to accommodate use by a standing human.

2. An amusement device in accordance with claim 1, wherein said magnetically permeable metal sheets having varying thickness, having rectangular dimensions and having indicia on the front and on the back of said magnetically permeable metal sheets.

3. An amusement device in accordance with claim 1, wherein said elongated tube having a coated bonded material covering the outer surface thereon.

4. An amusement device in accordance with claim 1, wherein said elongated tube having a predefined decorative outer sleeve at both ends of said elongated tube.

5. An amusement device for holding objects to accommodate use by a standing human comprising:

(a) an elongated tube of sufficient height to accommodate use by a standing human whereby, (b) said elongated tube having a hollow opening at both distal ends whereby, (c) housing a magnet inside said elongated tube at said distal ends, having said magnet surface exposed at both ends of said elongated tube and said magnet surface flush with said end of said elongated tube, (d) a plurality of magnetically permeable metal sheets having sufficient size for supporting said elongated tube in a vertical position and for holding objects to accommodate use by a standing human, (e) first means for attaching magnetically, said magnetically permeable metal sheets horizontally at right angles to said elongated tube vertically on the top of said elongated tube and on the bottom of said elongated tube at said distal ends of said elongated tube to said magnets, (f) second means for joining said elongated tube on top of first said magnetically permeable metal sheet as a supporting base and joining second said magnetically permeable metal sheet on top of said elongated tube as a platform thereby, providing a surface area for holding objects on top of second said magnetically permeable metal sheet to accommodate use by a standing human, (g) a set of instructions, paper sheets having indicia thereon representative of instructions and methods of assembling and performing said amusement device for holding objects to accommodate use by a standing human.

6. An amusement device in accordance with claim 5, wherein said magnetically permeable metal sheets having varying thickness, having rectangular dimensions and having indicia on the front and on the back of said magnetically permeable metal sheet.

7. An amusement device in accordance with claim 5, wherein said elongated tube having a coated bonded material covering the outer surface thereon.

8. An amusement device in accordance with claim 5, wherein said elongated tube having a predefined outer sleeve at both ends of said elongated tube.

* * * * *